US008085147B2

(12) United States Patent
Marriam et al.

(10) Patent No.: US 8,085,147 B2
(45) Date of Patent: Dec. 27, 2011

(54) SECURITY SYSTEM INCLUDING AUDIO ALARM DETECTION

(75) Inventors: Michael G. Marriam, West Henrietta, NY (US); James R Riley, Fairport, NY (US); Steven Markham, Rochester, NY (US)

(73) Assignees: Bosch Security Systems Inc, Broadview, IL (US); Robert Bosch GmbH, Stuttgart (DE)

( * ) Notice: Subject to any disclaimer, the term of this patent is extended or adjusted under 35 U.S.C. 154(b) by 357 days.

(21) Appl. No.: 12/275,571

(22) Filed: Nov. 21, 2008

(65) Prior Publication Data

US 2010/0127865 A1 May 27, 2010

(51) Int. Cl.
*G08B 13/00* (2006.01)

(52) U.S. Cl. ..... 340/541; 340/628

(58) Field of Classification Search ..... 340/541, 340/628

See application file for complete search history.

(56) References Cited

U.S. PATENT DOCUMENTS

| | | | | |
|---|---|---|---|---|
| 5,278,539 | A * | 1/1994 | Lauterbach et al. | 340/539.18 |
| 5,400,011 | A * | 3/1995 | Sutton | 340/566 |
| 5,736,927 | A * | 4/1998 | Stebbins et al. | 340/506 |
| 6,215,404 | B1 * | 4/2001 | Morales | 340/577 |
| 6,351,214 | B2 | 2/2002 | Eskildsen et al. | |
| 6,392,536 | B1 | 5/2002 | Tice et al. | |
| 7,103,152 | B2 | 9/2006 | Naidoo et al. | |
| 7,126,467 | B2 | 10/2006 | Albert et al. | |
| 7,129,833 | B2 | 10/2006 | Albert | |
| 7,148,797 | B2 | 12/2006 | Albert | |
| 7,170,404 | B2 | 1/2007 | Albert et al. | |
| 7,173,525 | B2 * | 2/2007 | Albert | 340/521 |
| 7,629,880 | B2 * | 12/2009 | Stilp et al. | 340/508 |
| 7,671,730 | B2 * | 3/2010 | Henderson | 340/531 |
| 7,697,492 | B2 * | 4/2010 | Petite | 340/870.02 |
| 2009/0003564 | A1 * | 1/2009 | Martin | 379/102.01 |

* cited by examiner

*Primary Examiner* — Eric M Blount
(74) *Attorney, Agent, or Firm* — Taft Stettinius & Hollister LLP; Keith J. Swedo

(57) ABSTRACT

A building security arrangement includes a sensor for emitting an audible alarm signal. A security system installed in the building detects the audible alarm signal and transmits an electrical alarm signal over a public switched telephone network in response to the detection of the audible alarm signal. A central monitoring station receives the electrical alarm signal over the public switched telephone network and notifies an alarm authority in response to receiving the electrical alarm signal.

20 Claims, 2 Drawing Sheets

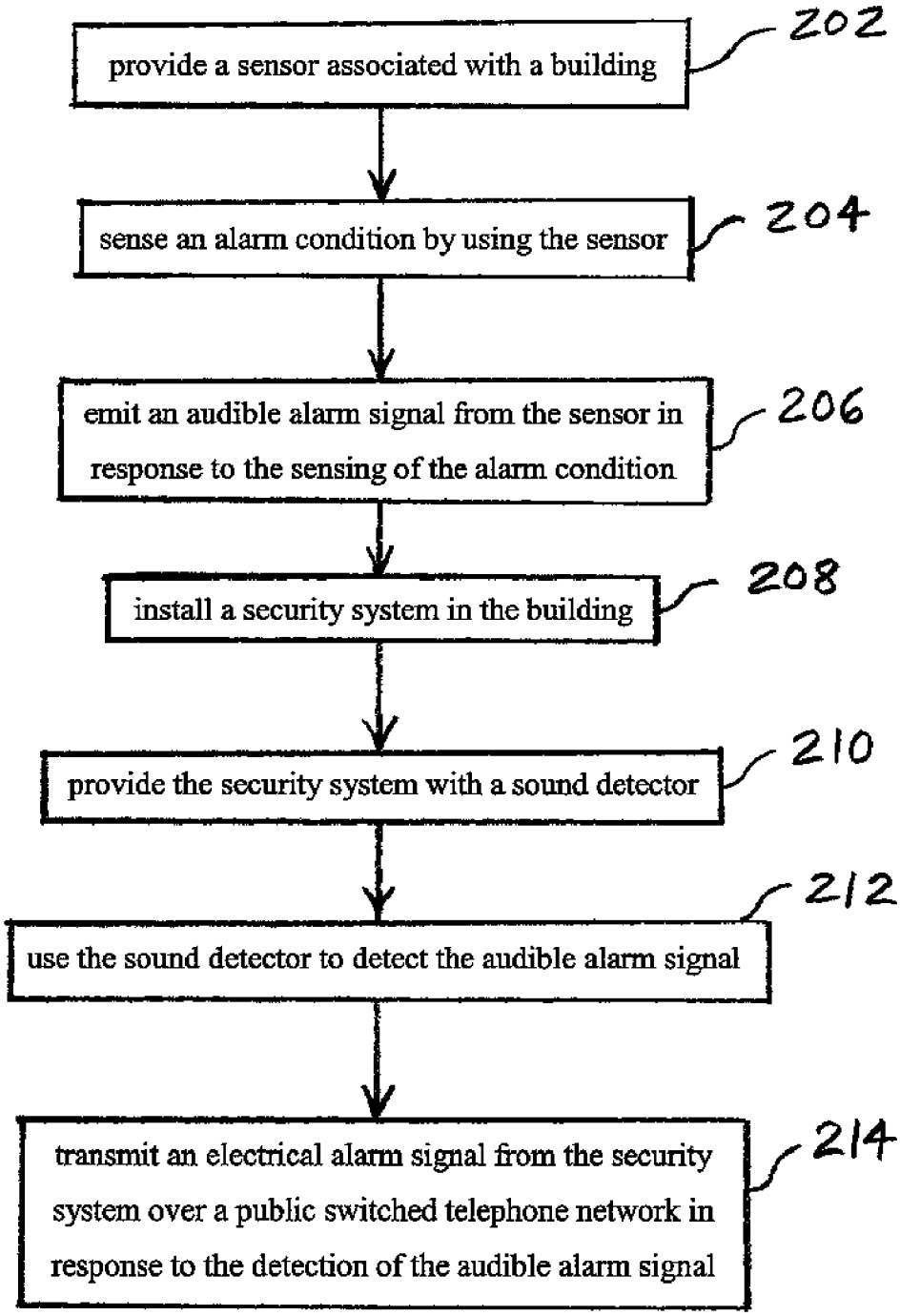
200 Fig. 2

SECURITY SYSTEM INCLUDING AUDIO ALARM DETECTION

BACKGROUND OF THE INVENTION

1. Field of the Invention

The present invention relates to surveillance systems, and, more particularly, to security systems that receive alarm signals from discrete sensors.

2. Description of the Related Art

Surveillance systems, also known as security systems, are known to include security devices, such as motion detectors, door sensors, window sensors, smoke detectors, etc., for monitoring a secured area of space. Most security systems have a range or variety of sensors to which the security system is connected. The manufacturers of the security systems develop sensors specifically for, and to be compatible with, their security systems. These sensors may be either hardwired to the system or may be in communication with the system via a wireless medium.

A class of consumer products has been developed including stand alone devices used to monitor and alert their users or to signal others of various exceptional conditions via an audible sounder. These devices range from battery operated smoke detectors to freezer thaw alarms to heavy equipment back-up warning devices. In every case when required these devices emit a loud, unmistakable sound.

A problem with such stand alone audible devices is that their effectiveness depends upon being heard by a person who can take appropriate action in response thereto. For example, a smoke alarm may sense smoke and emit an audible alarm in response thereto. However, if no person is within hearing distance of the smoke alarm, or if those hearing the alarm are physically unable to respond, then in that instance the smoke alarm is ineffective. A particular problem is that no central office or monitoring center receives notice of alarm conditions sensed by such stand alone audible devices.

What is needed in the art is a security system that can employ off-the-shelf stand alone audible devices in its network of sensors.

SUMMARY OF THE INVENTION

The present invention provides a security system that detects the alarm sound emitted by an off-the-shelf stand alone audible device and that notifies a central office of the alarm condition that is indicated by the audible device.

The invention is directed to the use of an audio alarm detection sensor to detect the sound emitted by stand alone consumer alarm products, such as battery operated smoke detectors, freezer thaw alarms, and heavy equipment back-up warning devices. The audio alarm detection sensor enables these disparate sensors to be interfaced to a security system as if the devices were designed to be part of the system. The security system then performs normal processing based upon its configuration parameters. Known audio frequencies and sound levels, perhaps established by regulatory agencies, may be preprogrammed into the audio alarm detection sensor by the manufacturer. Additional frequencies and sound levels may be learned into the audio alarm detection sensor by activating the audio alarm device upon or after sensor installation.

The invention provides a method for detecting audio alarms that are generated by devices that are not directly interfaced to or associated with an installed security system. The sound produced by these devices is normally intended to sound a local alert, and is typically very loud and of a specific frequency. The sound produced by these devices is detected by a security system of the present invention. When interfaced to a central monitoring office, the security system may enable authorities to become aware of and react to the alarm condition as if the alarm devices were designed to be part of the system. The present invention effectively provides a new "audio" method to link sensors to a security system.

By providing an audio alarm detection sensor to detect the sound emitted by these stand alone alarm devices, it is possible to interface these disparate sensors to a security system as if the devices were designed to be part of the system. The security system then performs normal processing based upon its configuration parameters.

According to the invention, known audio frequencies and sound levels, perhaps established by regulatory agencies, may be preprogrammed into the audio alarm detection sensor by the manufacturer. Additional frequencies and sound levels may be learned into the audio alarm detection sensor by activating the audio alarm device upon or after sensor installation.

The invention comprises, in one form thereof, a building security arrangement including a sensor for emitting an audible alarm signal. A security system installed in the building detects the audible alarm signal and transmits an electrical alarm signal over a public switched telephone network in response to the detection of the audible alarm signal. A central monitoring station receives the electrical alarm signal over the public switched telephone network and notifies an alarm authority in response to receiving the electrical alarm signal.

The invention comprises, in another form thereof, a building security method, including providing a sensor associated with the building. The sensor is used to sense an alarm condition. An audible alarm signal is emitted from the sensor in response to the sensing of the alarm condition. A security system is installed in the building. The security system is provided with a sound detector. The sound detector is used to detect the audible alarm signal. An electrical alarm signal is transmitted from the security system over a public switched telephone network in response to the detection of the audible alarm signal. The electrical alarm signal is received at a central monitoring station over the public switched telephone network. An alarm authority is notified in response to receiving the electrical alarm signal.

The invention comprises, in yet another form thereof, a building security arrangement including a security sensor installed in the building and emitting an audible alarm signal in response to sensing an alarm condition. A security system includes a sound detector for detecting the audible alarm signal. The security system is installed in the building and transmits an electrical alarm signal in response to the detection of the audible alarm signal. A telephone network is connected to the security system and receives and carries the electrical alarm signal. A central monitoring station is connected to the telephone network and receives the electrical alarm signal and notifies an alarm authority in response to receiving the electrical alarm signal.

An advantage of the present invention is that stand alone off-the-shelf security devices may be incorporated into a security system.

Another advantage of the present invention is that using a security system enables the audible alarm signal to be reliably and quickly reported to a central monitoring station via a public switched telephone network.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 2 is a flow chart of one embodiment of a building security method of the present invention.

Figure 1:
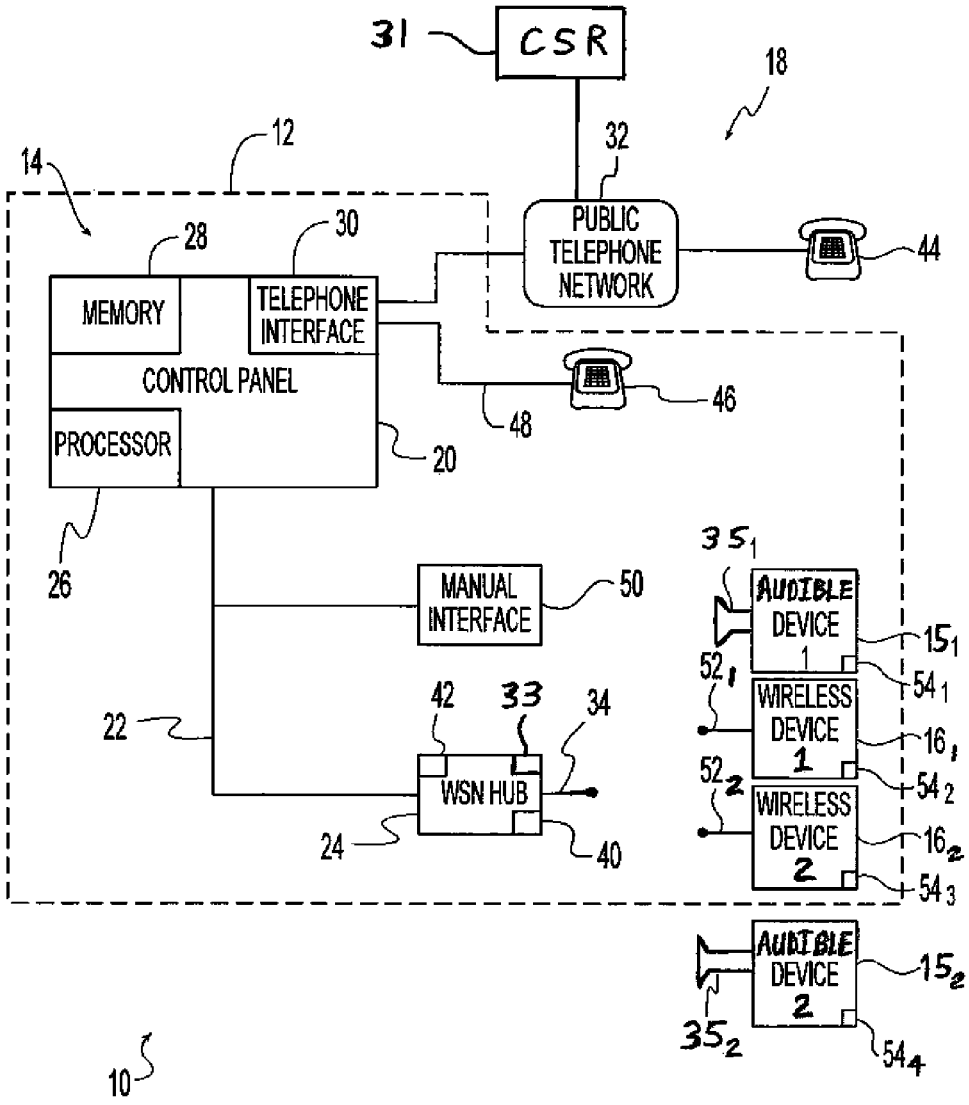
FIG. 1 is a block diagram of one embodiment of a building security arrangement of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security system 10 of the present invention for a structure 12 such as a building. However, system 10 may be used to secure other spaces, such as outdoor areas, subterranean rooms and passages, and zones of air space. System 10 includes a system controller 14, audible security devices $\mathbf{15}_1$, $\mathbf{15}_2$, non-audible wireless security devices $\mathbf{16}_1$, $\mathbf{16}_2$, and an installer interface 18. Audible security devices $\mathbf{15}_1$, $\mathbf{15}_2$ may be stand alone off-the-shelf security devices which may be designed by their manufacturer to be operable independently of security system 10.

System controller 14 includes a control device in the form of a control panel 20 electrically connected via an option bus 22 to a wireless sensor network (WSN) hub 24, which also may be referred to as a "wLSN hub". Control panel 20 may include a processor 26, a memory device 28 and a telephone interface 30. Processor 26 may coordinate communication with the various system components including installer interface 18 and WSN hub 24. Memory 28 may include software for interpreting signals from audible devices 15, wireless devices 16 and installer interface 18, and deciding based thereon whether to transmit an alarm signal from control panel 20. Memory 28 may also serve as a database for audible devices 15 and wireless devices 16. The alarm signal may be used to activate an audible alarm (not shown) within building 12, or to notify a central monitoring station or "central station receiver" (CSR) 31 such as a security company, fire station, or police station, for example, via public switched telephone network 32. Network 32 may otherwise be known as the network of the world's circuit-switched telephone networks. Memory 28 may also store identification information and configuration data for audible devices 15 and/or wireless devices 16, as described in more detail below.

WSN hub 24 may include a sound detector which may be in the form of a microphone 33 for receiving air-borne audible signals, such as audible alarm signals. The audible alarm signals may be transmitted from speakers or sirens $\mathbf{35}_1$, $\mathbf{35}_2$ of audible devices 15. Information from audible devices 15 may be passed by WSN hub 24 to control panel 20 via option bus 22. Control panel 20 may pass information to WSN hub 24 via option bus 22. WSN hub 24 may include a processor 40 and memory 42 for storing software, identification information associated with audible devices 15, and configuration data associated with audible devices 15.

WSN hub 24 may include an antenna element 34 for transmitting and receiving air-borne signals, such as radio frequency signals. The radio frequency signals may be received by and transmitted from, i.e., exchanged with, wireless devices 16. Information from wireless devices 16 may be passed by WSN hub 24 to control panel 20 via option bus 22. Control panel 20 may pass information to WSN hub 24 via option bus 22 for transmission to wireless devices 16 as necessary. WSN hub 24 may include a processor 40 and memory 42 for storing software, identification information associated with wireless devices 16, and configuration data associated with wireless devices 16.

Installer interface 18 may include an outside communication device 44, such as a cell phone, standard phone, or computer equipped with a modem; a house phone 46, which may be hard-wired to telephone interface 30 via a telephone line 48; and a manual interface 50, which may be in the form of a keypad. Manual interface 50 may be in communication with control panel 20 and WSN hub 24 via option bus 22. Thus, installer interface 18 may be in communication with system controller 14 via public telephone network 32, telephone line 48, and/or option bus 22. Installer interfaces including Ethernet or a networked connection are also possible.

Although only two audible devices 15 are shown in FIG. 1, it is to be understood that security system 10 may include any number of audible devices 15. Audible devices 15 may be in the form of any number or combination of smoke detectors, freezer thaw alarms, heavy equipment back-up warning devices, keyfobs including panic buttons, and any other devices that produce an audible alarm signal. Audible device $\mathbf{15}_1$ is indicated in FIG. 1 as being disposed inside building 12, and audible device $\mathbf{15}_2$ is indicated in FIG. 1 as being disposed outside building 12. However, any number of audible devices 15 may be disposed within building 12, and any number of audible devices 15 may be disposed outside building 12. Types of audible devices that may be permanently or temporarily disposed outside of building 12 during installation may include heavy equipment back-up warning devices and panic devices.

Although only two wireless devices 16 are shown in FIG. 1, it is to be understood that security system 10 may include any number of wireless devices 16. Wireless devices 16 may be in the form of any number or combination of window sensors, door sensors, glass break sensors, inertia sensors, motion detectors, smoke detectors, panic devices, gas detectors and keyfobs, for example. Window sensors and door sensors may detect the opening and/or closing of a corresponding window or door, respectively. Panic devices may be in the form of devices that human users keep on their person, and that are to be used to summon help in an emergency situation. Gas detectors may sense the presence of a harmful gas such as carbon monoxide, or carbon dioxide. A keyfob may be used to arm or disarm security system 10, and is another device that a user may possibly keep on his person. Each wireless device 16 includes a respective antenna element 52 for transmitting and receiving air-borne signals, such as radio frequency signals. The radio frequency signals may be received by and transmitted from, i.e., exchanged with, WSN hub 24. Wireless devices $\mathbf{16}_1$ and $\mathbf{16}_2$ are indicated in FIG. 1 as being disposed inside building 12. However, any number of wireless devices 16 may be disposed within building 12, and any number of wireless devices 16 may be disposed outside building 12. Types of wireless devices that may be permanently or temporarily disposed outside of building 12 during installation may include motion detectors, panic devices and keyfobs.

During installation, some types of audible devices 15 may be mounted or hung in a permanent or semi-permanent desired location. Examples of such types of audible devices 15 may include smoke detectors and freezer thaw alarms. Other types of audible devices 15 may be disposed in temporary locations during installation, or may even be in motion, such as a heavy equipment back-up warning device or a panic device or keyfob being carried on a user's person.

During installation, some types of wireless devices 16 may also be mounted or hung in a permanent or semi-permanent desired location. Examples of such types of wireless devices 16 may include window sensors, door sensors, glass break sensors, inertia sensors, motion detectors, smoke detectors, and gas detectors. Other types of wireless devices 16 may be disposed in temporary locations during installation, or may even be in motion, such as a panic device or keyfob being carried on a user's person.

During installation, the audible security devices 15 may be learned after a discover mode has been entered by actuating certain keys on the control panel. In the discover mode, hub 24 may be instructed to "discover" audible devices 15 and wireless devices 16 that need to be installed in system 10. Discovering an audible device may include actuating a test button on the audible device in order to cause the audible device to emit its audible alarm signal. Hub 24 may then use its sound detector 33 to determine audio characteristics of the alarm signal, such as its frequency profile and loudness, for example. The installer may use manual interface 50 to enter identifying information about the audible device that emits the alarm signal, such as the type of audible device, an identification number, and/or a location of the audible device. The audible device's identifying information may then be stored in memory 28 in association with the audible device's audio characteristics.

Discovering a wireless device 16 may involve two-way communication between hub 24 and the wireless device. More particularly, discovering a wireless device 16 may include receiving, assigning, or otherwise ascertaining unique identification information and configuration data for that device, such as an identification number, a type of the device, time periods when the device is on and off, supervision intervals (i.e., how often the device should report its status), operational parameters based upon the regulations in which the system is to operate, and/or a function of the device.

In a learn mode of operation, system controller 14 issues an air-borne signal requesting that each wireless device 16 that receives the request reply with an identification number and the type of the device. System controller 14 may store each identification number and its associated type in memory 28 for further reference. The identification number may be any string of alphanumeric characters and/or bits that uniquely identifies the wireless device with which the identification information is associated. This identification number may be included within any signal transmitted from a wireless device, both during installation and during surveillance operation of system 10, in order to identify which of wireless devices 16 that the signal is being transmitted from.

The device type information may specify whether the wireless device is a window sensor, door sensor, glass break sensor, inertia sensor, motion detector, smoke detector, gas detector, panic device or keyfob, for example. The device type information may further break down these categories by subcategories such as indoor or outdoor motion detector, garage door or front door sensor, carbon monoxide or carbon dioxide, etc.

Upon receiving the unique identifier of a device 15, 16, system controller 14 may look up the device's type, which may be stored in memory 28 or may be accessed on-line via the internet. Based on the device type, system controller 14 may make some assumptions about how the device should be configured, as discussed above. System controller 14 then may monitor the device dependent upon the type of the device. As used herein, the term "monitoring" may include supervising the security devices, such as by sending instruction signals to the security devices. The term "monitoring" may also include processing reporting signals from the security devices and deciding what action should be taken in response to the reporting signals. For example, system controller 14 may cause an alarm to issue depending upon both a reported change of status of the security device, and how the device has been configured.

Upon the completion of testing, system 10 may enter an operational mode in which system 10 performs its intended function of providing surveillance. In the operational mode, wireless devices 16 continue to report their statuses according to and dependent upon their configurations, and system controller 14 continues to monitor devices 15, 16 according to and dependent upon the configurations of devices 15, 16.

Each audible device 15 and wireless device 16 may be provided with an LED 54 that may light up or flash to indicate to the installer that the device is transmitting, or has recently transmitted, some type of signal. If the LED does not light up or flash at the desired device, then the installer may need to perform some troubleshooting. For example, the installer may check the battery (not shown) of the device or replace the device with another one.

There may be an occasion when the default configuration that control system 14 has assigned to a device 15, 16 needs to be changed to suit a particular application. In order to modify the configuration of a device, a user may access manual interface 50 and key in replacement configuration data for the device.

During use, one of audible devices $\mathbf{15}_1$, $\mathbf{15}_2$ may sense an alarm condition and respond thereto by emitting an audible alarm signal. Sound detector 33 receives and detects the audible alarm and processor 26 recognizes the sound as an alarm signal by virtue of its sound characteristics, such as frequency profile and/or loudness. In one embodiment, processor 26 may determine which of audible devices $\mathbf{15}_1$, $\mathbf{15}_2$ has emitted the audible alarm signal by analyzing the sound's identifying characteristics. If, for example, processor 26 determines that an audible device in the form of a smoke detector is emitting the sound, then this identification may be forwarded to CSR 31 such that the proper authorities, e.g., the local fire department, may be notified to respond to the alarm.

One embodiment of a method 200 of the present invention is illustrated in FIG. 2. In a first step 202, a sensor associated with a building is provided. For example, audible devices $\mathbf{15}_1$, $\mathbf{15}_2$ associated with building 12 are provided.

In a second step 204, an alarm condition is sensed by using the sensor. For example, an audible device in the form of a smoke detector may sense the presence of smoke.

Next, in step 206, an audible alarm signal is emitted from the sensor in response to the sensing of the alarm condition. That is, in response to sensing smoke, an audible device in the form of a smoke detector may emit a loud, high pitched alarm signal that is commonly employed by conventional off-the-shelf smoke detectors.

In step 208 a security system is installed in the building. For example, a complete security system 10 may be installed in building 12 in addition to audible devices 15.

In a next step 210, the security system may be provided with a sound detector. In the specific embodiment of FIG. 1, security system 10 is provided with a sound detector 33.

Next, in step 212, the sound detector is used to detect the audible alarm signal. That is, sound detector 33 may be used to detect the audible alarm signals emitted by audible devices 15.

In a final step 214, an electrical alarm signal is transmitted from the security system over a public switched telephone network in response to the detection of the audible alarm signal. For example, an electrical alarm signal may be transmitted from security system 10 over a public switched telephone network 32 in response to sound detector 33 detecting the audible alarm signal emitted by one of audible device 15.

The present invention has been described herein in connection with audible security devices and wireless security devices. However, it is to be understood that many aspects of the present invention are equally applicable to audible security devices alone, or audible security devices used in conjunction with conventional, hard-wired security devices.

While this invention has been described as having an exemplary design, the present invention may be further modified within the spirit and scope of this disclosure. This application is therefore intended to cover any variations, uses, or adaptations of the invention using its general principles.

What is claimed is:

1. A building security method, comprising the steps of:

providing an off-the-shelf audible security sensor associated with the building;

sensing an alarm condition, the sensing being performed by the sensor;

emitting an audible alarm signal from the sensor in response to the sensing of the alarm condition;

installing a security system in the building;

transmitting instruction signals from the security system to the sensor;

providing the security system with a sound detector;

using the sound detector to detect the audible alarm signal;

transmitting an electrical alarm signal from the security system over a public switched telephone network in response to the detection of the audible alarm signal; and accessing a manual interface and keying in replacement configuration data for the audible sensor to suit an application, thereby changing a default configuration assigned to the audible sensor.

2. The method of claim 1 comprising the further steps of receiving the electrical alarm signal at a central monitoring station.

3. The method of claim 1 wherein the installing step includes storing a sound characteristic of the audible alarm signal in association with identification information for the sensor, the method comprising the further step of identifying the sensor based upon characteristics of the audible alarm signal, wherein the identifying step occurs after the using step and before the transmitting of the electrical alarm signal.

4. A building security method, comprising the steps of:

providing a first audible sensor associated with the building;

sensing an alarm condition, the sensing being performed by the sensor;

emitting an audible alarm signal from the sensor in response to the sensing of the alarm condition;

installing a security system in the building;

transmitting instruction signals from the security system to the sensor;

providing the security system with a sound detector;

using the sound detector to detect the audible alarm signal;

transmitting an electrical alarm signal from the security system over a public switched telephone network in response to the detection of the audible alarm signal;

providing a second audible sensor associated with the building;

in a discover mode:

causing each of the first and second audible sensors to emit a first audible alarm signal and a second audible alarm signal, respectively;

using the sound detector to determine respective audio characteristics of each of the first and second audible sensors, the audio characteristics including a frequency profile and loudness; and storing identifying information about each of the first and second audible sensors in association with the respective audio characteristics of the sensors; and in an operating mode, identifying from which of the first and second audible sensors a detected audible alarm signal was received, the identifying being based on the frequency profile and loudness of the detected audible alarm signal.

5. A building security method, comprising the steps of:

providing a sensor associated with the building;

sensing an alarm condition, the sensing being performed by the sensor;

emitting an audible alarm signal from the sensor in response to the sensing of the alarm condition;

installing a security system in the building, wherein the security system includes a system controller and first and second wireless devices associated with the building;

transmitting instruction signals from the security system to the sensor;

providing the security system with a sound detector;

using the sound detector to detect the audible alarm signal;

transmitting an electrical alarm signal from the security system over a public switched telephone network in response to the detection of the audible alarm signal;

in a learn mode:

using the system controller to issue an air-borne signal requesting that each of the wireless devices reply with an identification number and a type of the wireless device;

using each of the wireless devices to transmit a respective signal with a respective identification number and a respective type of the wireless device;

using the system controller to store each identification number and its associated type in memory, the identification number being a string of alphanumeric characters and/or bits that uniquely identifies the wireless device with which the identification information is associated, the identification number being included within every signal transmitted from each of the wireless devices both during learn mode and during surveillance operation mode of the security system; and using the system controller to make assumptions about how each of the wireless devices should be configured, the assumptions being based on the device type; and in an operation mode, using the system controller to transmit instruction signals to the first and second wireless devices, the instruction signals being dependent upon the device type.

6. The method of claim 2 comprising the further step of notifying an alarm authority in response to receiving the electrical alarm signal.

7. The method of claim 1 wherein the installing step includes storing a sound characteristic of the audible alarm signal in association with identification information for the sensor.

8. The method of claim 7 comprising the further step of identifying the sensor based upon characteristics of the audible alarm signal.

9. The method of claim 8 wherein the identifying step occurs after the using step and before the transmitting of the electrical alarm signal.

10. The method of claim 1 wherein the sensor comprises a smoke detector.

11. The method of claim 1 comprising the further step of identifying the sensor based upon characteristics of the audible alarm signal.

12. The method of claim 1 wherein the security system includes at least one non-audible security device.

13. The method of claim 1 comprising the further step of storing characteristics of the audible alarm signal in association with identification information for the sensor.

14. The method of claim 4 comprising the further steps of receiving the alarm signal at a central monitoring station.

15. The method of claim 14 comprising the further step of notifying an alarm authority in response to receiving the electrical alarm signal.

16. The method of claim 4 wherein the installing step includes storing a sound characteristic of the audible alarm signal in association with identification information for the sensor, the method comprising the further step of identifying the sensor based upon characteristics of the audible alarm signal, wherein the identifying step occurs after the using step and before the transmitting step.

17. The method of claim 4 wherein the installing step includes storing a sound characteristic of the audible alarm signal in association with identification information for the sensor.

18. The method of claim 5 comprising the further steps of:

transmitting an electrical alarm signal to a central monitoring station; and notifying an alarm authority in response to receiving the electrical alarm signal.

19. The method of claim 5 wherein the installing step includes storing a sound characteristic of the audible alarm signal in association with identification information for the sensor, the method comprising the further step of identifying the sensor based upon characteristics of the audible alarm signal, wherein the identifying step occurs after the using step and before the transmitting step.

20. The method of claim 5 wherein the installing step includes storing a sound characteristic of the audible alarm signal in association with identification information for the sensor.

* * * * *